United States Patent [19]

Duggan

[11] Patent Number: 4,577,186

[45] Date of Patent: Mar. 18, 1986

[54] FIRE DETECTOR

[75] Inventor: Jack Duggan, Markham, Canada

[73] Assignee: Fire Detection Devices Ltd., Markham, Canada

[21] Appl. No.: 578,642

[22] Filed: Feb. 9, 1984

[51] Int. Cl.[4] ..... G08B 17/00

[52] U.S. Cl. ..... 340/589; 340/590

[58] Field of Search ..... 340/589, 592, 590; 374/107; 116/106; 337/4, 416, 402, 403, 405, 406; 169/42

[56] References Cited

U.S. PATENT DOCUMENTS

| | | | |
|---|---|---|---|
| 1,174,149 | 3/1916 | Himmer | 337/328 |
| 2,389,429 | 11/1945 | Griffith | 340/593 X |
| 2,510,756 | 6/1950 | Reger | 169/42 |
| 2,779,998 | 2/1957 | Bailey | 29/512 |
| 3,271,547 | 9/1966 | Seeley | 337/409 |
| 3,717,860 | 2/1973 | Tipton et al. | 340/589 |
| 3,827,012 | 7/1974 | Duggan | 337/320 |
| 4,116,357 | 9/1978 | Stanley, Jr. | 220/228 X |

*Primary Examiner*—James L. Rowland
*Assistant Examiner*—Jeffery A. Hofsass
*Attorney, Agent, or Firm*—Ivor M. Hughes

[57] ABSTRACT

An improved fire detector appropriately vented to atmosphere is provided, the detector comprising a base supporting a diaphragm enclosing a space between the base and diaphragm, a shell secured to the base enclosing the diaphragm, and a fin for collecting heat from the ambient atmosphere, secured by a ferrule to the shell. A vent aperture is provided through the base from the space between the diaphragm and the base to the back of the detector and which detector is covered by a closure cap. The fin is secured to the shell by a ferrule by causing peripheral portions of the end of the ferrule proximate the central aperture of the fin through which the ferrule is inserted to be forced to be indented to cause metal from such peripheral portions to flow radially over portions of the fin.

26 Claims, 7 Drawing Figures

FIG. 4.
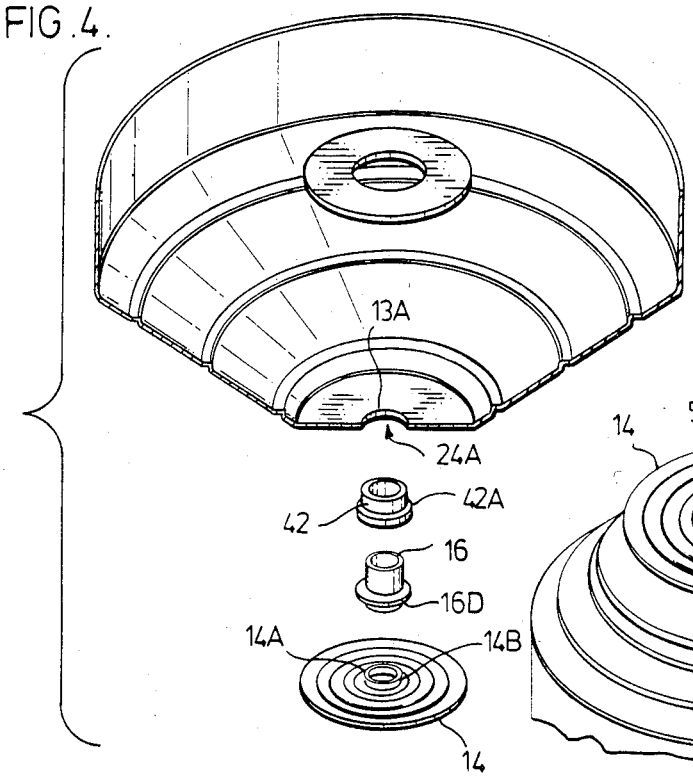
FIG. 7.
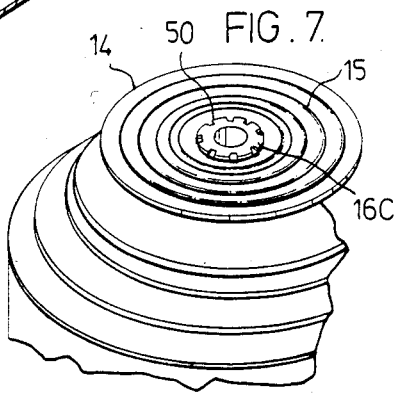
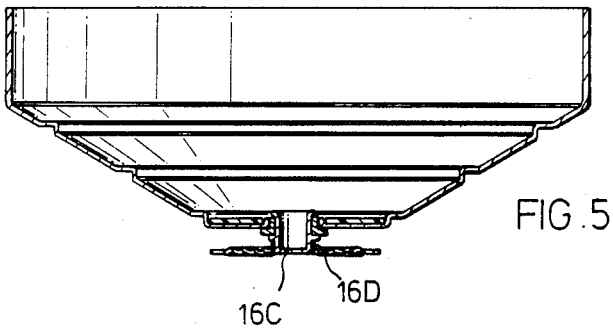
FIG. 5.
FIG. 6.
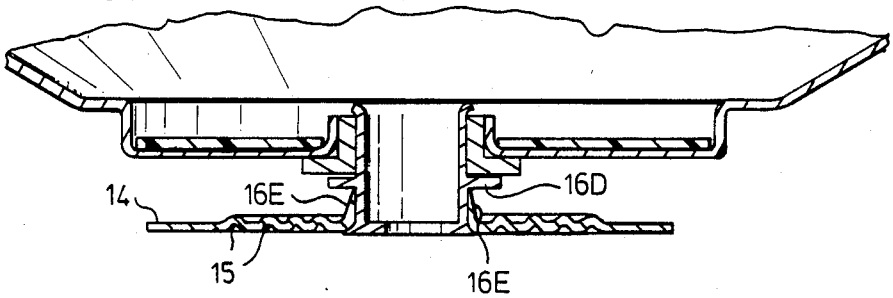

FIRE DETECTOR

FIELD OF INVENTION

This invention relates to improvements in fire detectors and structural components therefor.

BACKGROUND OF THE INVENTION

Fire detector devices may be designed to actuate an alarm by closing or opening a circuit on the happening of either one, or both, of two events—when the rate of rise of the temperature of the ambient atmosphere exceeds a predetermined prescribed standard, for example, the 15° F. per minute standard set by Underwriter Laboratories of Canada and Underwriter Laboratories Inc. of the United States, and/or when the ambient temperature exceeds a predetermined fixed temperature.

These detectors must also operate in all environmental conditions, for example, extremes of humidity, variations of heat and cold, and acidic or alkaline vapour mediums.

The necessity for such operation has been recognized by various governmental and independent examining bodies, and standards have been set which the devices must meet or exceed. One such body in the Fire Insurers' Research and Testing Organization (FIRTO for short) of the United Kingdom, who as part of its testing program, has prescribed that such fire detectors must pass a sulphuric acid environment test. This test requires that the fire detector sit in a sulphuric acid environment for a predetermined time and thereafter, still be operable. However, no fire detector that was vented to atmosphere tested with the rate of rise feature before my detector disclosed in Canadian Patent Application Ser. No. 336,801 has remained operable after the time period spent in the sulphuric acid vapour medium. The reason lies in the construction of the vented detector incorporating the rate of rise feature. The chambers between the shell and the diaphragm, and diaphragm and base, must be vented to atmosphere to permit normal atmospheric expansion and contraction due to temperature fluctuations without actuating the alarm. However, if any of the vent apertures are left unprotected in the acidic environment (especially the vent aperture opening from the space between the diaphragm and base) the acidic environment is drawn into the chambers when the detector is "breathing" during normal temperature fluctuations, thus corroding the electrical contacts in the spaces.

In Canadian Patent Application Ser. No. 336,801 I have disclosed an improved fire detector vented to atmosphere, capable of closing or opening an alarm circuit when the rate of rise of the temperature of the ambient atmosphere exceeds a predetermined prescribed rate of rise of temperature comprising a base supporting a diaphragm enclosing a space between the base and diaphragm, a shell secured to the base enclosing a space between the diaphragm and shell, electrical circuit contacts mounted on the base for being closed or opened when the actual rate of rise of the temperature of the atmosphere in the space between the diaphragm and shell exceeds a predetermined rate of rise of temperature, vent apertures through the base from the spaces between the diaphragm and shell, and the diaphragm and base, to the back of the detector, the improvement comprising the vent apertures each being surrounded by an endless wall covered by a closure cap having a top and depending skirt, small projections disposed between the top of the closure cap and the top of the endless wall and thin posts or lugs between the endless wall and depending skirt for spacing the top of the wall from the top of the closure cap and spacing the endless wall from the depending skirt to cover the vent aperture permitting the spaces between the diaphragm and base, and shell and base, to be vented to the atmosphere under normal expansion and contraction of the ambient atmosphere in the fire detector without drawing substantial amounts of air from outside the cover and wall through the vent apertures.

While this proposal went a long way to overcome the problems hereinbefore referred to, nevertheless, small amounts of dust material have from time to time entered the vent aperture.

Detectors of the type described usually carry a heat collecting fin outside the shell and are connected to the shell by a ferrule. The ferrule also carries a fusible link to a detent member within the shell. When heat reaches the fin the heat is transferred from the fin through the ferrule to the fusible link. It is therefore preferable, to provide the heat collecting fin with as large a surface area as possible to maximum heat collection. Where the fin and ferrule were combined in one piece, the fin could not be manufactured of sufficiently large enough diameter at reasonable cost. Where attempts have been made to make the fin-ferrule combination from two components, as was done prior to my invention disclosed in my co-pending Application Ser. No. 336,801 with the fin of large diameter, the union has not yielded a satisfactory result.

In my co-pending Application Ser. No. 336,801 I disclosed an improved fire detector having alarm actuating means for actuating an alarm at a predetermined temperature and a fin for collecting heat from the ambient atmosphere, the fin being connected by a ferrule to the alarm actuating means for actuating the alarm at the predetermined temperature, the connection between the fin and the ferrule having been formed by causing metal in an end portion of the ferrule to flow over fin metal surrounding the aperture of the fin through which aperture the ferrule extends to provide a thin layer of ferrule metal over fin metal.

As a result, the metal of the ferrule was married to the metal of the fin. In that way, an anodized aluminum fin of relatively large diameter (and thus non-solderable, but immune to sulphuric acid) could be intimately connected to solderable blind hole tin plated aluminum ferrule.

However, it has been found that in some instances during the marrying of the fin to the ferrule, the pressure to hold the fin to the ferrule while ferrule material was caused to flow radially over the fin material, distorted the fin and in some of those instances, the pressure applied in one area caused the connection of the fin to the ferrule to buckle and loosen in another area.

It is therefore an object of this invention to provide an improved fire detector and structural components useful therefor.

Further and other objects of the invention will be realized by those skilled in the art from the following summary of the invention and detailed description of embodiments thereof.

SUMMARY OF THE INVENTION

Unexpectedly, according to one aspect of the invention, an improved fire detector vented to atmosphere, capable of closing or opening an alarm circuit when the rate of rise of the temperature of the ambient atmosphere exceeds a predetermined prescribed rate of rise of temperature is provided comprising a base supporting a diaphragm enclosing a space between the base and diaphragm, a shell secured to the base enclosing a space between the diaphragm and shell, electrical circuit contacts mounted on the base in the space between the diaphragm and shell for being closed or opened when the rate of rise of the temperature of the atmosphere exceeds a predetermined rate of rise of temperature, at least one vent aperture through the base from the space between the diaphragm and base to the back of the detector, and at least one vent aperture through the base from the space between the base and shell to the back of the detector, the at least one vent aperture through the base between the diaphragm and base to the back of the detector being surrounded by an endless wall covered by a closure cap having a top and depending skirt, the closure cap spaced from the endless wall by relatively small projections between the top of the closure cap and the top of the endless wall and by relatively thin posts or lugs between the endless wall and depending skirt for spacing the endless wall from the depending skirt, (preferably the wall including the relatively small projections on the top of the endless wall and the relatively thin posts or lugs extending from the side of the wall, to enable the closure cap to snugly seat (on the small projections on the top of the endless wall and against the outer surface of the thin posts or lugs) the depending skirt being such as to extend to a position above (preferably just above) the bottom of the endless wall remote the top of the endless wall whereby the atmosphere between the diaphragm and base is permitted to expand into the space between the endless wall and skirt which in turn forces air therefrom into the space at the back of the detector under normal expansion of the ambient atmosphere and draws air into the vent aperture substantially only from the space between the endless wall and skirt under normal contraction of the ambient atmosphere between the diaphragm and base thereby precluding dust and other contaminents in the space at the back of the detector from entering the vent aperture. In one embodiment the at least one vent aperture through the base from the space between the base and shell is similarly covered.

According to another aspect of the invention, an improved fire detector is provided comprising a base, a shell secured to the base, a fin secured to the shell by a ferrule passing through the shell at one end and secured to a detent member carried in the shell by a fusible link and at the other end by the ferrule passing through a centrally disposed aperture through the fin, the improvement comprising the fin being connected to the ferrule by causing substantially equally spaced peripheral portions of the ferrule at the end of the ferrule passing through the centrally disposed aperture, to be indented to cause metal from such portions to be forced to flow substantially radially over portions of the fin surrounding the aperture in the fin, as for example, by swaging whereby the outer surface of the ferrule engages fin metal surrounding the aperture and metal forced to flow radially from the peripheral indented portions overlies and engages the fin to provide a joint between the two which permits efficient heat transfer between the two.

Preferably, the substantially equally spaced peripheral portions are forced to flow substantially radially over the portions of the fin substantially simultaneously.

In one embodiment, circumferentially equally spaced portions totalling about one third of the peripheral portion of the ferrule are swaged to flow over portions of the fin metal surrounding the aperture in the fin.

In various such embodiments, the side wall of the ferrule proximate the end of the ferrule passing through the centrally disposed aperture may be angled about 5° to the longitudinal axis of the ferrule tapering from the end remote the fin towards the end proximate the fin.

According to another aspect of the invention, an improved fire detector is provided having alarm actuating means for actuating an alarm at a predetermined temperature and a fin for collecting heat from the ambient atmosphere, the improvement comprising an improved union between the fin and ferrule, the fin having a centrally disposed aperture therethrough for receiving the ferrule and, being connected by the ferrule to alarm actuating means for actuating an alarm at a predetermined temperature, the improved connection between the fin and ferrule having been formed by swaging equally spaced peripheral end portions of the ferrule totalling about one third of the peripheral at the end of the ferrule to be indented to cause ferrule material to flow radially over fin metal surrounding the aperture in the fin whereby the outer surface of the ferrule engages fin metal surrounding the aperture and metal forced to flow radially from the peripheral indented portions overlies and engages the fin to provide a joint between the two which permits efficient heat transfer between the two.

Preferably, the substantially equally spaced peripheral end portions of the ferrule are caused to substantially simultaneously flow radially over fin metal surrounding the aperture.

For best union, the side wall proximate the end of the ferrule secured to the fin is tapered (preferably at an angle of about 5° to the longitudinal axis of the ferrule) away from the other end of the ferrule remote the fin.

Preferably,, the aperture through the fin, through which the ferrule is passed is only slightly larger than the end of the ferrule to provide a tight fit therebetween as the ferrule is pushed into the aperture to cause the tapered ferrule to engage fin material to cause a tight fit therebetween.

According to another aspect of the invention, the equally spaced peripheral end portions of the ferrule caused to flow radially over the fin may each be triangular in shape, with the apex of each triangular portion spaced from the periphery and with the broadest portion of the triangular portion being remote the apex and overlying the fin.

Preferably, the equally spaced peripheral end portions of the ferrule are caused to flow over the fin metal at substantially the same time.

As a result, the required ferrule and fin connection is achieved minimizing distortion and minimizing crushing, of the components during the union of the fin and ferrule.

The invention will now be illustrated with reference to the following drawings of an embodiment of the invention.

BRIEF DESCRIPTION OF THE DRAWINGS

FIG. 4 is an exploded view of part of the detector shown in FIGS. 1 and 2.

FIG. 5 is a vertical cross-sectional side view of part of the detector shown in FIGS. 1, 2, 3 and 4.

FIG. 6 is a close up view of part of the structure shown in FIG. 5.

FIG. 7 is a close-up view of the union between fin and ferrule of the detector shown in FIG. 1.

DETAILED DESCRIPTION OF PREFERRED EMBODIMENTS OF THE INVENTION

Figure 1:
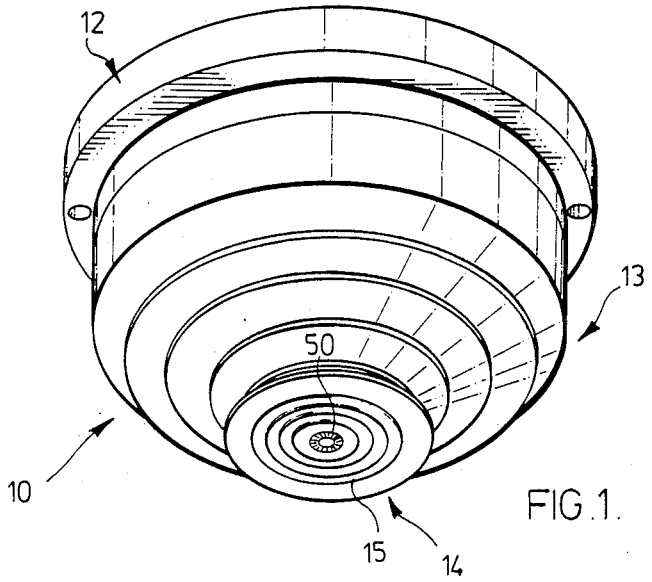
FIG. 1 is a perspective view of a fire detector operating to actuate an alarm, when the rate of rise of the temperature of the ambient air exceeds a predetermined prescribed rate and, when the ambient temperature exceeds a predetermined fixed temperature, according to a preferred embodiment of the invention.
Figure 2:
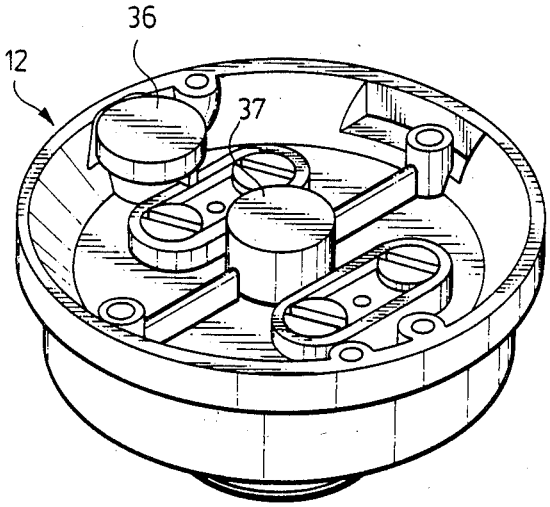
FIG. 2 is a top perspective view of the fire detector of FIG. 1.

With reference to FIG. 1, there is shown a fire detector 10, comprising base 12, and outer cup-shaped shell 13 carrying annular heat collecting fin 14. Fin 14 is corrugated having spaced concentric annular ridges 15 (See FIG. 6). Fin 14 is positioned with respect to shell 13 by tin plated aluminum ferrule 16 (see FIG. 4) extending through central aperture 16A through the center of shell 13.

Figure 3:
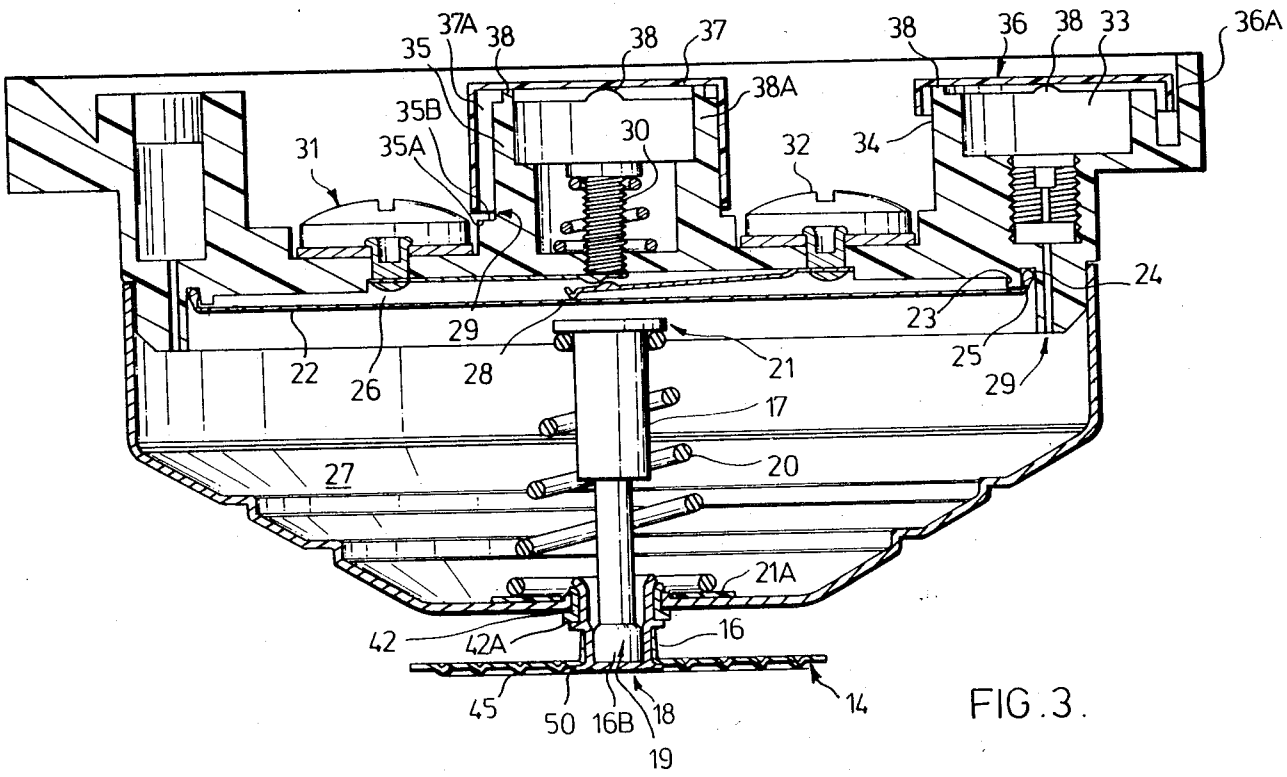
FIG. 3 is a cross-sectional view of the fire detector shown in FIGS. 1 and 2.

Ferrule 16 supports detent member 17 (See FIG. 3) in blind bore 18 of ferrule 16 by fusible link 19. Dentent member 17 supports tapered compression spring 20, tapering in a direction away from fin 14, and being compressed between flange 21 on the end of detent member 17, and gasket 21A adjacent shell 13 until fusible link 19 fuses.

Diaphragm 22 (See FIG. 3) is stretched over annular wall 23 of base 12 into annular trough 24 and held there by a gasket 25 (sealed therein by epoxy) for dividing the space between shell 13 and base 12 into two compartments 26 and 27. Compartment 26 houses contacts 28 for closing the circuit on the happening of a hazardous situation. Calibrated vent 29 leads from compartment 27 to the back of base 12 and permits predetermined amounts of air to pass therethrough under normal conditions of expansion and contraction of air within compartment 27. Compartment 26 vents through aperture 30. On the other side of base 12 are electrical contact screws 31 and 32, opening 33 for vent 29 surrounded by annular wall 34, and an opening for aperture 30, surrounded by annular wall 35. Each of apertures 29 and 30 are covered by closure caps 36 and 37 respectively. Spacer projections 38, 1/32" (about 8/19 mm) high are disposed on the top of annular walls 34 and 35 on which the caps 36 and 37 seat respectively. Each cap 36 and 37 is slightly larger by the radial thicknesses of the thin post or lugs 38A secured to the sides of annular walls 34 and 35 to snugly secure the caps to the wall. Each lug or post is of a circumferential length of about 3/32" (2 4/10 mm.). Therefore, continuous communication is permitted through the openings between the lugs and posts from the back of the detector to the vent apertures. Whereas the length of skirt 36A of cap 36 is short, the length of skirt 37A of cap 37 is much longer extending parallel to wall 35 to just about the bottom 35A of wall 35 leaving an annular air space or opening 35B between the cap 37 and wall 35 when cap 37 is snugly seated on wall 35 thus permitting communication of vent aperture 30 with the space at the back of the detector whereby the atmosphere between the diaphragm 22 and base 12 is permitted to expand into the space between endless wall 35 and skirt 37A which in turn forces air therefrom into the space at the back of the detector 10 under normal expansion of the ambient atmosphere and draws air into the vent aperture 30 substantially only from the space between endless wall 35 and skirt 37A under normal contraction of the ambient atmosphere between diaphragm 22 and base 12 to ensure contaminants are precluded from entering the vent aperture from the back of the detector. Vent aperture 29 could have been covered in a similar manner.

With particular reference to FIGS. 1,3,4,5,6 and 7, corrugated anodized aluminum fin 14 carrying spaced concentric annular ridges 15, is secured to shell 13 by tin plated ferrule 16 extending through central aperture 24A in the center of shell 24 and curled over or swaged over the inside edge 13A (See FIG. 4) of shell 13 surrounding aperture 24A (See FIG. 5) (after annular resilient tubular member 42 carrying radial flange 42A has been interposed between ferrule 16 and shell 12. Ferrule 16 is pressure fit through aperture 14A of fin 14 in intimate contact with the annular wall 14B surrounding aperture 14A. Radial flange 42A seats on flange 16D of ferrule for sealing opening 24A and compartment 27.

Ferrule 16 supports detent member 17 in blind bore 16B by fusible link 19. Ferrule 16 comprises bottom horizontally extending face 16C, tapered annular side wall 16E tapering towards face 16C at an angle of 5° to the longitudinal axis of the ferrule normal to face 16C from radially extending flange 16D (see FIGS. 3 and 6).

Ferrule 16 has been united or pinned to fin 14 by causing equally spaced circumferential or peripheral portions of the end of ferrule 16 (face 16C) totalling about ⅓ (one-third) of the peripheral portion of the end of ferrule 16 to be forced to be indented to cause metal from such portions to flow radially over fin 14 proximate aperture 14A (See FIGS. 1 and 6 and particularly FIG. 7) at substantially the same time.

By this union, heat conduction from fin 14 to the ferrule is maximized and the union between fin 14 and ferrule 16 is accomplished without distorting fin 14 or causing one area of the joint or union to buckle or loosen. The union may be accomplished by a punch having a face the negative of the impression left on the end of ferrule 16 on face 16C (see FIG. 7), after having applied the punch vertically for simultaneously causing equally spaced peipheral portions of the end of ferrule 16 to be indented to cause metal from such portions to flow radially over fin 14 proximate aperture 14A, towards the periphery of fin 14 while supporting fin 14 and ferrule 16 against movement to thereby provide a more secure joint which permits efficient heat transfer.

As many changes can be made to construction of the embodiment of the invention without departing from the scope of the invention, it is intended that all material contained herein be interpreted as illustrative of the invention and not in a limiting sense.

The embodiments of the invention in which an exclusive property or privilege is claimed are as follows:

1. An improved fire detector vented to atmosphere, capable of closing or opening an alarm circuit when the rate of rise of the temperature of the ambient atmosphere exceeds a predetermined prescribed rate of rise of temperature comprising a base supporting a diaphragm enclosing a space between the base and diaphragm, a shell secured to the base enclosing s space between the diaphragm and shell, electrical circuit contacts mounted on the base in the space between the diaphragm and shell for being closed or opened when the rate of rise of the temperature of the atmosphere exceeds a predetermined rate of rise of temperature, at least one vent aperture through the base from the space between the diaphragm and base to the back of the detector, and at least one vent aperture through the base from the space between the base and shell to the back of the detector, the at least one vent aperture through the base between the diaphragm and base to the back of the detector, being surrounded by an endless wall covered by a closure cap having a top and depending skirt, the closure cap spaced from the endless wall by relatively small projections between the top of the closure cap and the top of the endless wall and by relatively thin posts or lugs between the endless wall and depending skirt for spacing the endless wall from the depending skirt, the depending skirt being such as to extend to a position above the bottom of the endless wall remote the top of the endless wall whereby the atmosphere between the diaphragm and base is permitted to expand into the space between the endless wall and skirt which in turn forces air therefrom into the space at the back of the detector under normal expansion of the ambient atmosphere and draws air into the vent aperture substantially only from the space between the endless wall and skirt under normal contraction of the ambient atmosphere between the diaphragm and base thereby precluding dust and other contaminants in the space at the back of the detector from entering the vent aperture.

2. The fire detector of claim 1, wherein the other at least one vent aperture is similary covered.

3. The fire detector of claim 1, wherein each wall includes the relatively small projections on the top of the endless wall and the relatively thin posts or lugs extending from the side of the wall to enable the closure cap to snugly seat on the small projections on the top of the endless wall and against the outer surface of the thin posts or lugs.

4. The fire detector of claim 1, wherein each wall includes the relatively small projections on the top of the endless wall and the relatively thin posts or lugs extending from the side of the wall to enable the closure cap to snugly seat on the small projections on the top of the endless wall and against the outer surface of the thin posts or lugs.

5. The fire detector of claim 1 or 2, wherein the depending skirt of the closure cap is such as to extend to a position just above the bottom of the endless wall remote the top of the endless wall.

6. The fire detector of claim 3 or 4, wherein the depending skirt of the closure cap is such as to extend to a position just above the bottom of the endless wall remote the top of the endless wall.

7. An improved fire detector comprising a base, a shell secured to the base, a fin secured to the shell by a ferrule passing through the shell at one end and secured to a detent member carried in the shell by a fusible link and at the other end by the ferrule passing through a centrally disposed aperture through the fin, the improvement comprising the fin being connected to the ferrule by causing substantially equally spaced peripheral portions of the ferrule at the end of the ferrule passing through the centrally disposed aperture, to be indented to cause metal from such portions to be forced to flow substantially radially over portions of the fin, surrounding the aperture in the fin, whereby the outer surface of the ferrule engages fin metal surrounding the aperture and metal forced to flow radially from the peripheral indented portions overlies and engages the fin to provide a joint between the two which permits efficient heat transfer between the two.

8. The fire detector of claim 7, wherein the connection is accomplished by substantially simultaneously causing the substantially equally spaced peripheral portions to be forced to flow substantially radially over portions of the fin.

9. The fire detector of claim 7, wherein the causing of the equally spaced peripheral portions of the ferrule to be forced to flow radially over portion of the fin is accomplished by swaging.

10. The fire detector of claim 8, wherein the causing of the equally spaced peripheral portions of the ferrule to be forced to flow radially over portion of the fin is accomplished by swaging.

11. The fire detector of claim 7, wherein the substantially equally spaced portions of the ferrule that are forced to flow substantially radially comprises about one third of the peripheral portion of the ferrule.

12. The fire detector of claim 8, wherein the substantially equally spaced portions of the ferrule that are forced to flow substantially radially comprises about one third of the peripheral portion of the ferrule.

13. The fire detector of claim 9, wherein the substantially equally spaced portions of the ferrule that are forced to flow substantially radially comprises about one third of the peripheral portion of the ferrule.

14. The fire detector of claim 10, wherein the substantially equally spaced portions of the ferrule that are forced to flow substantially radially comprises about one third of the peripheral portion of the ferrule.

15. The fire detector of claim 7, 8 or 9, wherein the side wall of the ferrule proximate the end of the ferrule passing through the centrally disposed aperture is angled about 5° to the longitudinal axis of the ferrule tapering from the end remote the fin towards the end proximate the fin.

16. The fire detector of claim 10, 11, or 12, wherein the side wall of the ferrule proximate the end of the ferrule passing through the centrally disposed aperture is angled about 5° to the longitudinal axis of the ferrule tapering from the end remote the fin towards the end proximate the fin.

17. The fire detector of claim 13 or 14, wherein the side wall of the ferrule proximate the end of the ferrule passing through the centrally disposed aperture is angled about 5° to the longitudinal axis of the ferrule tapering from the end remote the fin towards the end proximate the fin.

18. An improved fire detector having alarm actuating means for actuating an alarm at a predetermined temperature and a fin for collecting heat from the ambient atmosphere, the improvement comprising an improved union between the fin and ferrule, the fin having a centrally disposed aperture therethrough for receiving the ferrule and being connected by the ferrule to alarm actuating means for actuating an alarm at a predetermined temperature, the improved connection between the fin and ferrule having been formed by swaging equally spaced peripheral end portions of the ferrule totalling about one third of the periphery at the end of the ferrule to be indented to cause ferrule material to flow radially over fin metal surrounding the aperture in the fin, whereby the outer surface of the ferrule engages fin metal surrounding the aperture and metal forced to flow radially from the peripheral indented portions overlies and engages the fin to provide a joint between the two which permits efficient heat transfer between the two.

19. The fire detector of claim 18, wherein the substantially equally spaced peripheral end portions of the ferrule are caused to substantially simultaneously flow radially over fin metal surrounding the aperture.

20. The fire detector of claim 18, wherein the side wall proximate the end of the ferrule secured to the fin is tapered at an angle of 5° to the longitudinal axis of the ferrule away from the end of the ferrule secured to the fin.

21. The fire detector of claim 19, wherein the side wall proximate the end of the ferrule secured to the fin is tapered at an angle of 5° to the longitudinal axis of the ferrule away from the end of the ferrule secured to the fin.

22. The detector of claim 18, wherein the aperture through the fin, through which the ferrule is passed is only slightly larger than the end of the ferrule to provide a tight fit therebetween.

23. The detector of claim 19, wherein the aperture through the fin, through which the ferrule is passed is only slightly larger than the end of the ferrule to provide a tight fit therebetween.

24. The detector of claim 20 or 21, wherein the aperture through the fin, through which the ferrule is passed is only slightly larger than the end of the ferrule to provide a tight fit therebetween.

25. The fire detector of claim 18, 19 or 20, wherein some of the substantially equally spaced peripheral portions caused to flow radially over the fin are triangular in shape, with the apex of each triangular portion spaced from the periphery and with the broadest portion of the triangular portion being remote the apex and overlying the fin.

26. The fire detector of claim 21, 22 or 23, wherein some of the substantially equally spaced peripheral portions caused to flow radially over the fin are triangular in shape, with the apex of each triangular portion spaced from the periphery and with the broadest portion of the triangular portion being remote the apex and overlying the fin.

* * * * *